US005925222A

United States Patent [19]

Dudler

[11] Patent Number: 5,925,222

[45] Date of Patent: Jul. 20, 1999

[54] LEVELER BAR FOR COKE OVENS

[75] Inventor: Heinz Dudler, Herne, Germany

[73] Assignee: Thyssen Still Otto Anlagentechnik GmbH, Bochum, Germany

[21] Appl. No.: 08/930,462

[22] PCT Filed: Feb. 29, 1996

[86] PCT No.: PCT/EP96/00819

§ 371 Date: Dec. 18, 1997

§ 102(e) Date: Dec. 18, 1997

[87] PCT Pub. No.: WO96/26945

PCT Pub. Date: Sep. 6, 1996

[30] Foreign Application Priority Data

Mar. 18, 1995 [DE] Germany ..... 295 04 642 U

[51] Int. Cl.[6] ..... C10B 37/02

[52] U.S. Cl. ..... 202/262; 202/291; 202/265; 202/270

[58] Field of Search ..... 202/262, 265, 202/221, 105, 251, 270

[56] References Cited

U.S. PATENT DOCUMENTS

| | | | |
|---|---|---|---|
| 1,937,734 | 12/1933 | Underwood | 212/23 |
| 5,176,489 | 1/1993 | Schroter | 414/587 |

FOREIGN PATENT DOCUMENTS

| | | |
|---|---|---|
| 233361 | 9/1909 | Germany . |
| 899336 | 12/1953 | Germany . |
| 902842 | 1/1954 | Germany . |
| 922411 | 1/1955 | Germany . |
| 925710 | 3/1955 | Germany . |
| 937043 | 12/1955 | Germany . |
| A 1 058 018 | 5/1959 | Germany . |

*Primary Examiner*—Bekir L. Yildirim
*Attorney, Agent, or Firm*—McGlew and Tuttle, P.C.

[57] ABSTRACT

The invention concerns a leveler bar for coke ovens for levelling the coke debris cone forming below the filling holes in the furnace chamber during the filling process. The leveler bar comprises interconnected support elements which extend over the entire length of the oven chamber and are disposed parallel to one another at a distance dependent on the width of the oven chamber. According to the invention, the leveler bar comprises at least three support elements which are arranged parallel to one another, extend over the entire length of the oven chamber and are disposed relative to one another such that the leveler bar has a triangular cross-section. The two lower support elements are disposed at the same level and the upper support element is arranged centrally thereabove.

17 Claims, 2 Drawing Sheets

LEVELER BAR FOR COKE OVENS

FIELD OF THE INVENTION

The invention concerns a leveller bar for coke ovens for levelling the coke bulk charging cone forming below the charging holes of a coke oven chamber during the coal charging process. The leveller bar comprises interconnected support elements which extend over the entire length of the oven chamber and which are arranged in parallel to one another at a distance dependent on the width of the oven chamber.

BACKGROUND OF THE INVENTION

DE 40 34 341 C2 describes a prior art leveller bar consisting of vertical metal plates arranged in a longitudinal oven direction and in parallel to each other, with there being transverse coal entrainment carriers located at regular distances in the intermediate space confined by the vertical plates.

Moving of leveller bars of this type into the oven chamber during the coal charging process usually blocks the oven free space above the coal charge by approx. 60% (see FIG. 1 attached hereto). This constraint frequently involves clogging inside the oven free space by the end of the coal charging process and, associated therewith, serious emission because the charging gases can no longer be discharged to the suction point, i.e. to the standpipe or to the gas jumper pipe.

DE-A 10 58 018 describes a leveller bar for coke ovens. The part of the bar which is movable into the coke oven is provided with two side wings comprising web-type connection elements arranged at certain distances. The two side wings are shaped like closed hollow girders with evenly arched sheff plates. Clogging and emissions as a consequence thereof may occur because of the continuous lateral metal plates.

SUMMARY AND OBJECTS OF THE INVENTION

It is an object of this invention to propose a new design and construction for the coal leveller bar making it feasible to exhaust the charging gases always, if possible, in an unrestricted manner.

According to the invention a coke oven leveller bar arrangement is provided for levelling the coke bulk charging cone forming below a charging hole of a coke oven chamber during the coal charging process. The leveller bar is formed of interconnected support elements extending over an entire length of the oven chamber and arranged in parallel to one another at a distance dependent on the width of the oven chamber. The leveller bar includes at least three supporting elements which extend over an entire length of the oven chamber. The three supporting elements are arranged as an open trusswork-like construction. The open trusswork-like construction has a triangular cross-section including two lower supporting elements arranged at the same level and an upper supporting element located centrally there above.

The three supporting elements may preferably be provided to form an equilateral or isosceles cross-section of the leveller bar with a vertical symmetrical plane. The supporting elements are preferably interconnected in a longitudinal direction at regular distances through horizontal lower transverse braces and/or through connecting braces pointing obliquely upward to the supporting element. The supporting braces may be arranged diagonally between the lower supporting elements and/or the upper supporting element, between two supporting braces each. The supporting elements and/or the braces may each be provided with a closed cross-section. The supporting elements and braces may be provided with the same and/or equally sized cross-section. All supporting elements and braces may consist substantially of commercial-type tubes with a round or square cross-section.

The leveller bar which is the subject of this invention mainly represents a trusswork girder of a triangular cross-section. This only blocks the oven free space during coal levelling by approximately 25%. Thus a clogging of the oven free space with coal is largely prevented and the charging gases evolving on coal charging can be discharged unrestrictedly in the longitudinal oven direction to the relevant points of suction. Moreover, the trusswork-like design and construction comprised of transverse braces arranged at regular distances only and of individual, diagonally extending supporting braces also allow for a lateral flow passage through the leveller bar, that means transversely to the longitudinal oven direction.

The individual construction elements of the leveller bar expediently consist of commercial-type tubes sized with diameters which are equal in all areas. In this way a low-cost and—because of the hollow cross-sections—relatively lightweight but nevertheless stable construction of the leveller bar is achieved.

The invention is more closely explained by way of FIGS. 1 to 4 attached hereto serving as examples.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF FIG. 1

Figure 1:
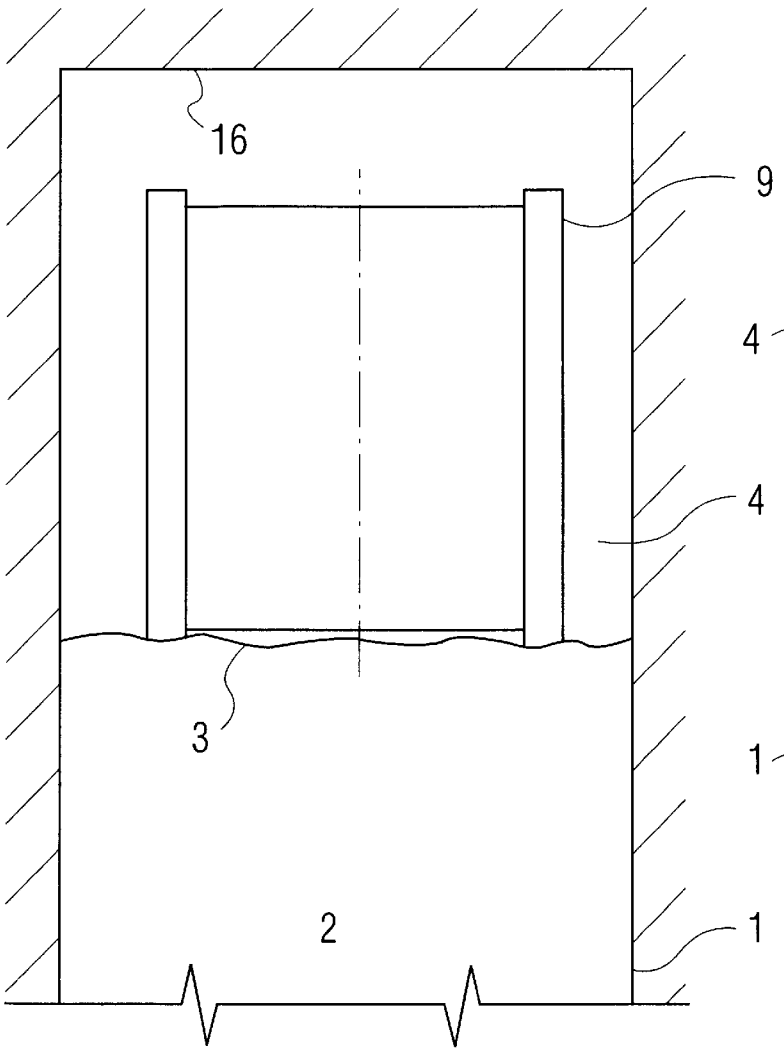
FIG. 1 is a cross-sectional view showing a prior art leveller bar arrangement.

FIG. 1 in a cross-section shows the arrangement of a leveller bar 9 built to the state of the art, located in an oven free space 4 confined by the lateral coking chamber walls 1, the top edge 3, the coal charge 2 in the chamber, and by the oven chamber ceiling 16. The leveller bar built to the state of the art mainly consists of two vertical metal plates arranged in parallel to each other and interconnected with each other. During coal levelling this leveller bar occupies approx. 57% of the cross-section of the entire oven free space 4.

DESCRIPTION OF THE PREFERRED EMBODIMENT

Figure 2:
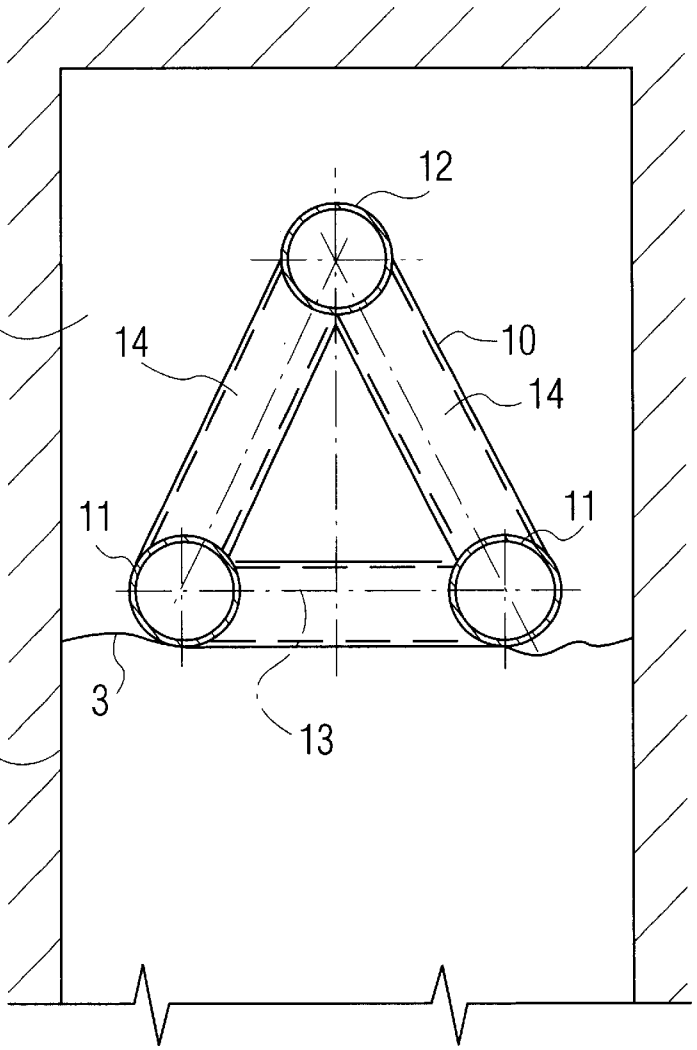
FIG. 2 is a cross-sectional view similar to FIG. 1 showing the leveller bar being the subject of this invention with the triangular, equilateral cross-section.
Figure 3:
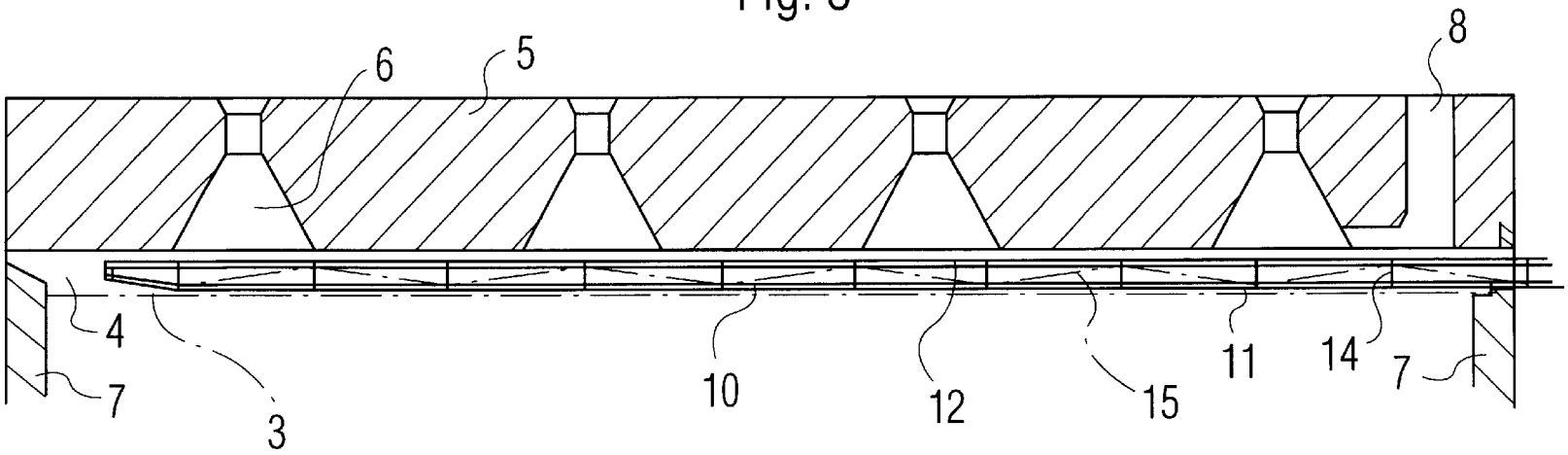
FIG. 3 in a longitudinal section shows the arrangement of the leveller bar in the oven free space of a coke oven chamber; and, FIG. 4 in a magnified top view shows a typical leveller bar segment.
Figure 4:
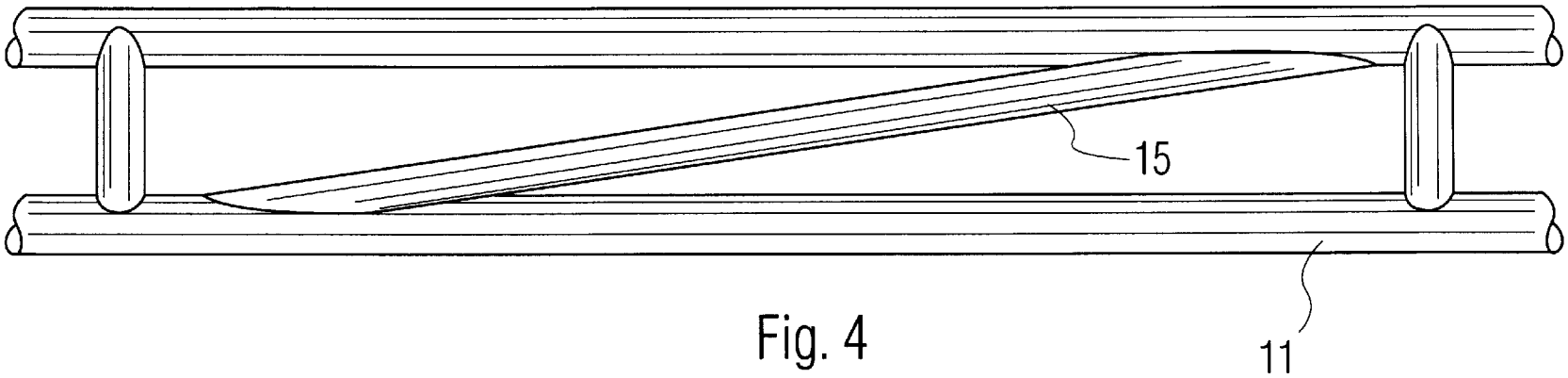

Referring to the drawings in particular, the invention as shown in FIGS. 2, 3 and 4 comprises a leveller bar arrangement. The leveller bar according to the invention comprises two lower supporting elements 11 which are arranged at the same level and are arranged in parallel to each other. These supporting elements 11 are interconnected at regular distances through horizontally arranged transverse braces 13. Arranged centrally above the transverse brace 13, there is provided an upper supporting element 12. The upper supporting element 12 is connected with the two lower supporting elements 11 through the connecting braces 14. For stabilization, as shown in FIG. 4, the two lower supporting elements 11 (FIG. 3 shows each of the lower supporting elements 11) are connected to the upper supporting element 12 is connected with the diagonally extending supporting brace 15. Each supporting brace 15 is affixed at connection points of the supporting elements 11 with the transverse braces 13 and/or affixed at the upper supporting elements 12 with the connecting braces 14.

FIG. 3 also illustrates the top of the oven 5, the charging holes 6, the standpipe 8 and the coke oven door 7. A leveller door opening is located in the upper area of the coke oven door 7 on the pusher side. Through this leveller door opening the leveller bar 10 can be moved in horizontally and longitudinal directions into the oven free space floor for the coal levelling process.

While specific embodiments of the invention have been shown and described in detail to illustrate the application of the principles of the invention, it will be understood that the invention may be embodied otherwise without departing from such principles.

I claim:

1. A coke oven leveller bar for levelling a coke bulk charging cone forming below a charging hole of a coke oven chamber during a coal charging process, comprising:

interconnected supporting elements extending over an entire length of the oven chamber, said interconnected supporting elements being arranged in parallel to one another at a distance based on the width of the oven chamber, said supporting elements being provided as three supporting elements extending over an entire length of the oven chamber arranged as an open trusswork-like construction to provide a triangular cross-section with two lower supporting elements being arranged at a same level and with an upper supporting element being located substantially centrally thereabove.

2. A leveller bar according to claim 1, wherein said three supporting elements form one of an equilateral or isosceles cross-section to form a leveller bar with a vertical symmetrical plane.

3. A leveller bar according to claim 1, wherein said supporting elements are interconnected in longitudinal direction at regular distances by one of horizontal lower transverse braces and/or through connecting braces pointing obliquely upward to said upper supporting element.

4. A leveller device according to claim 1, further comprising diagonally arranged supporting braces extending between one of said lower supporting elements and between said upper supporting element and one of said lower supporting elements, said diagonally arranged supporting brace being disposed between two supporting braces.

5. A leveller bar according to claim 1, wherein said supporting elements are each provided with a closed cross-section.

6. A leveller bar according to claim 4, wherein at least one of said braces and said diagonally arranged supporting brace is provided with a closed cross-section.

7. A leveller bar according to claim 6, wherein each of said supporting elements and said braces is provided with a same and/or equally sized cross-section.

8. A leveller bar according to claim 6, wherein each of said supporting elements and braces consist of commercial-type tubes with rounded or square cross-section.

9. A coke oven leveller bar arrangement, comprising:

a coke oven defining a coke oven chamber with a charging hole forming a charging cone below said charging hole, during a coal charging process; and a leveller bar including a plurality of supporting elements extending over an entire length of said oven chamber, said supporting elements being arranged in parallel to one another spaced a distance proportional to a width of said oven chamber, said supporting elements being arranged as an open trusswork-like construction having a triangular cross-section including two lower supporting elements arranged at a same level and an upper supporting element located substantially centrally above said lower supporting elements.

10. A leveller bar arrangement according to claim 9, wherein said lower supporting elements and said upper supporting element form one of an equilateral and isosceles cross-section with a vertical symetrical plane.

11. A leveller bar arrangement according to claim 9, further comprising horizontal lower transverse braces interconnecting said lower support elements in a longitudinal direction, said transverse brace is being provided at regular distances.

12. A leveller bar arrangement according to claim 9, further comprising connecting braces connecting each lower supporting element to said upper supporting element, said connecting braces pointing obliquely upward.

13. A leveller device according to claim 11, further comprising diagonal supporting braces arranged diagonally between each lower supporting element and said upper supporting element, between two said connecting braces.

14. A leveller device according to claim 12, further comprising diagonal supporting braces arranged diagonally between each lower supporting element and said upper supporting element, between two said transverse braces.

15. The leveller arrangement according to claim 14, wherein at least one of said supporting elements and said braces is provided with a closed cross-section.

16. A leveller bar according to claim 15, wherein each of said supporting elements and said braces are provided with the same and/or equally sized cross-section.

17. A leveller bar according to claim 16, wherein each of said supporting elements and said braces consist of commercial-type tubes with one of a round and square cross-section.

* * * * *